US006273763B1

(12) United States Patent
Daoud

(10) Patent No.: US 6,273,763 B1
(45) Date of Patent: Aug. 14, 2001

(54) CONNECTOR ASSEMBLY AND DISASSEMBLY DEVICE

(75) Inventor: Bassel Hage Daoud, Morris County, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/515,399

(22) Filed: Feb. 29, 2000

(51) Int. Cl.[7] ..... H01R 9/26

(52) U.S. Cl. ..... 439/716; 439/715

(58) Field of Search ..... 439/532, 708, 439/715, 716, 719; 29/762, 764

(56) References Cited

U.S. PATENT DOCUMENTS 5,330,366 * 7/1994 Tsuji et al. ..... 439/352

* cited by examiner

*Primary Examiner*—Brian Sircus
*Assistant Examiner*—Michael C. Zarroli

(57) ABSTRACT

A connector assembly and disassembly device includes a connector having a plurality of connections. A block is provided for receiving the connector in an operative position for forming an array of individual connectors. At least one latch is provided for securing the connector to the block. A latch separator engages the at least one latch to enable the connector to be removed from the block. The connector includes five connections with five pairs of latches for securing the connector to the block. End latches are provided for securing end portions of the connector to the block. The latch separator includes a plurality of projections for engaging individual latches of the connector for disengaging the latches from the block.

10 Claims, 3 Drawing Sheets

CONNECTOR ASSEMBLY AND DISASSEMBLY DEVICE

BACKGROUND OF THE INVENTION

1. Field of the Invention

A connector assembly and disassembly device includes a connector including a plurality of connections. A block is provided for receiving the connector in an operative position for forming an array of individual connectors. At least one latch is provided for securing the connector to the block. A latch separator engages the at least one latch to enable the connector to be removed from the block.

2. Description of Background Art

Hithertofore, it was difficult to disassemble a connector that included a plurality of connections in view of the limited space provided between adjacent connections. An individual was required to displace each set of latches for each of the connections prior to be enabled to remove the connector from a block. The difficulties in removing the connector from the block increased the time needed for checking and repairing a connector assembly.

SUMMARY AND OBJECTS OF THE INVENTION

The present invention is provided to enable an individual to quickly assemble or disassemble a connector that includes a plurality of connections from a block. A latch separator permits an individual to quickly assemble or disassemble a connector even though a limited space is provided between adjacent connections. Each set of latches for each of the connections can be engaged by the latch separator to permit an individual to remove the connector from the block. The latch separator reduces the time needed for removing the connector from the block to quickly facilitate the checking and repairing of a connector assembly.

These and other objects of the invention are achieved by providing a connector assembly and disassembly device that includes a connector including a plurality of connections. A block is provided for receiving the connector in an operative position for forming an array of individual connectors. At least one latch is provided for securing the connector to the block. A latch separator engages the at least one latch to enable the connector to be removed from the block. End latches are provided for securing end portions of the connector to the block. The latch separator includes a plurality of projections for engaging individual latches of the connector for disengaging the latches from the block.

In an embodiment of the invention, the connector may include five connections with five pairs of latches for securing the connector to the block.

Further scope of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
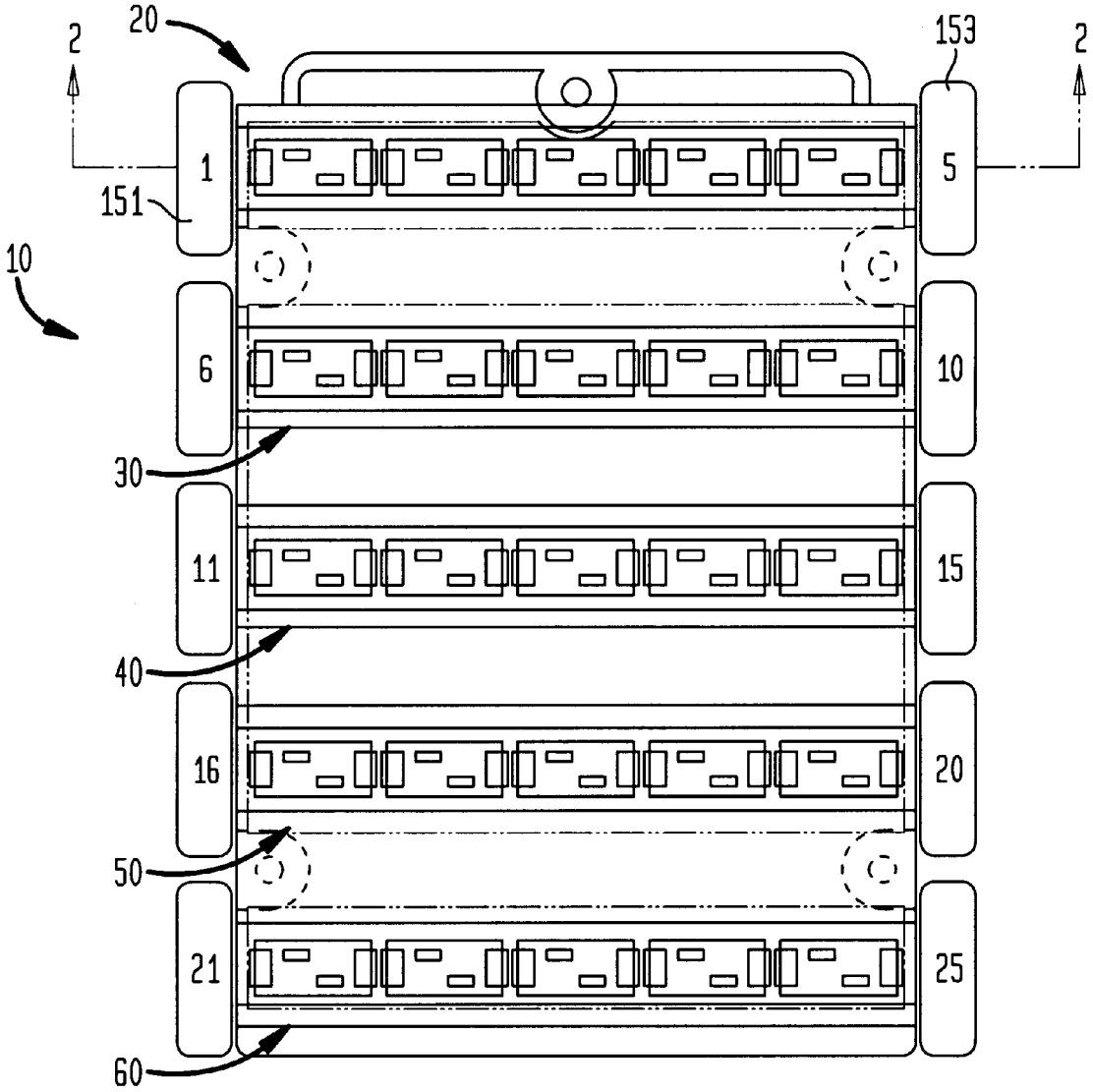
FIG. 1 is top plan view of a plurality of connectors composed of a plurality of individual connectors.

As illustrated in FIGS. 1–5, a connector assembly and disassembly device 10 includes a connector 12 including a plurality of connectors 20, 30, 40, 50 and 60 arranged in groups of five connectors. A block 14 is provided for receiving the groups of connectors 20, 30, 40, 50 and 60 in an operative position for forming an array of individual connectors. At least one latch 121, 221 is provided for securing the connector 12 to the block 14. A latch separator 301 engages the at least one latch 121 to enable the connector 12 to be removed from the block 14. The connector 20 includes five connections 21, 22, 23, 24 and 25 with five pairs of latches 121, 221; 122, 222; 123, 223; 124, 224; and 225 for securing the connector 12 to the block 14. End latches 121 and 225 are provided for securing end portions of the connector 21 and 25 to the block 14. The latch separator 301 includes a plurality of projections 321, 322, 323, 324, 325 and 326 for engaging individual latches 121, 221; 122, 222; 123, 223; 124, 224; and 225 of the connectors 21, 22, 23, 24 and 25 for disengaging the latches 121, 221; 122, 222; 123, 223; 124, 224; and 225 from the block 14.

Figure 2:
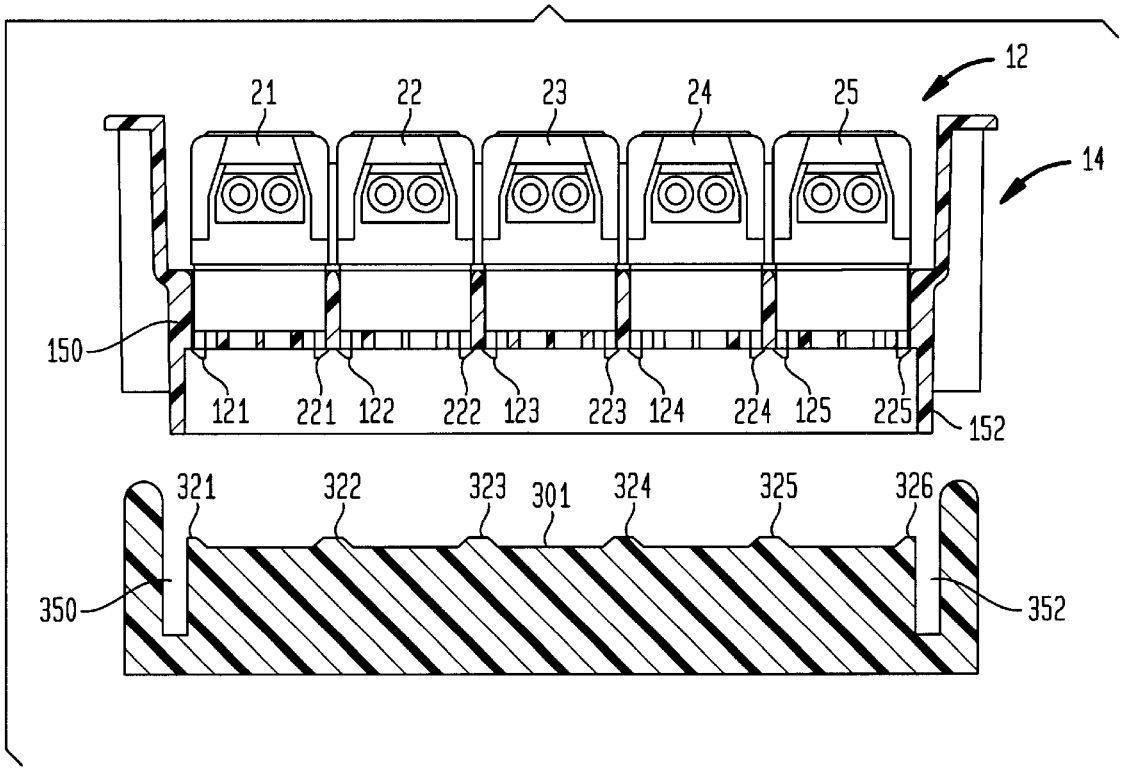
FIG. 2 is a cross-sectional view taken along line 2—2 as illustrated in FIG. 1 and illustrating a latch separator for disassembly of the connector from a block that forms an array of connectors being disposed below the connector.

As illustrated in FIGS. 1 and 2, the connector assembly and disassembly device 10 includes the connector 12 having the plurality of connections 21, 22, 23, 24, 25. The block 14 is provided for receiving the connector 12 in an operative position for forming an array of individual connectors. At least one latch 121, 122 is provided for securing the connector 12 to the block 14.

As illustrated in FIG. 2, the latch separator 301 engages the at least one latch 121, 122 to enable the connector 12 to be removed from the block 14. Each of the connectors 20, 30, 40 and 50 includes five connections. For example, the connector 20 includes the connections 21, 22, 23, 24 and 25 with five pairs of latches 121, 221; 122, 222; 123, 223; 124, 224 and 125, 225 for securing the connectors 21, 22, 23, 24 and 25 to the block 14

Figure 3:
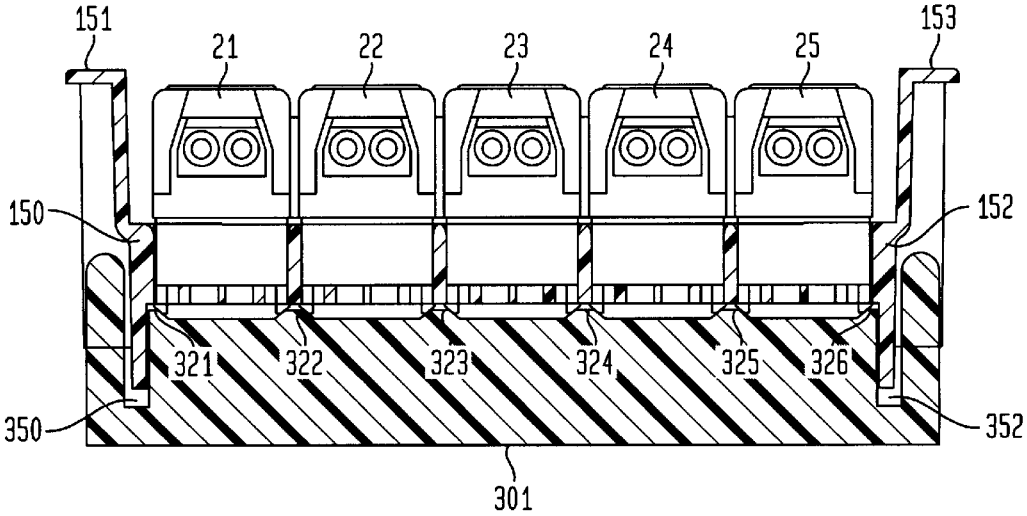
FIG. 3 is a cross-sectional view of a connector as the latch separator that includes individual projections formed on the latch separator begin to engage latches for disassembly of the connector from the block.

As illustrated in FIG. 3, the block 14 includes housing projections 150, 152 that extend downwardly from handle portions 151, 153. The housing projections 150, 152 are adapted to fit within the troughs 350, 352 of the latch separator 301. As the housing projections 150, 152 are received within the troughs 350, 352 the projections 321, 332, 323, 324, 325 and 326 initially engage the latches 121; 221, 122; 222, 123; 223, 124; 224, 125; and 225 of the connector 12 for disengaging the latches 121; 221, 122; 222, 123; 223, 124; 224, 125; and 225 from the block 14.

Figure 4:
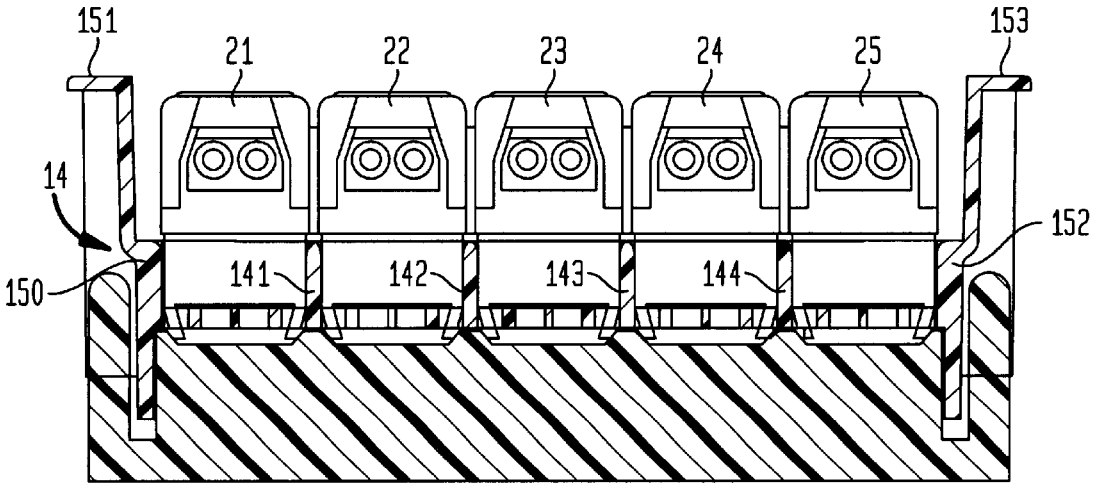
FIG. 4 is a cross-sectional view of a connector illustrating the individual projections of the latch separator continuing to engage the latches for disassembly of the connector from the block.

As illustrated in FIG. 4, as the housing projections 150, 152 extend farther into the troughs 350, 352 the projections 321, 332, 323, 324, 325 and 326 complete the biasing of the latches 121; 221, 122; 222, 123; 223, 124; 224, 125; and 225 of the connector 12 for completing the disengagement of the latches 121; 221, 122; 222, 123; 223, 124; 224, 125; and 225 from the block 14. In FIG. 4, a small gap is provided between the projections 321, 332, 323, 324, 325 and 326 and the stays 141, 142, 143 and 144 of the block 14. This small gap will permit the latches 121; 221, 122; 222, 123; 223, 124; 224, 125; and 225 of the connector 12 to reconnect to the block 14. An additional downward deflection is needed to close the gap between the projections 321, 332, 323, 324, 325 and 326 and the stays 141, 142, 143 and 144 of the block 14 to ensure the removal of the connector 12 from the block 14.

Figure 5:
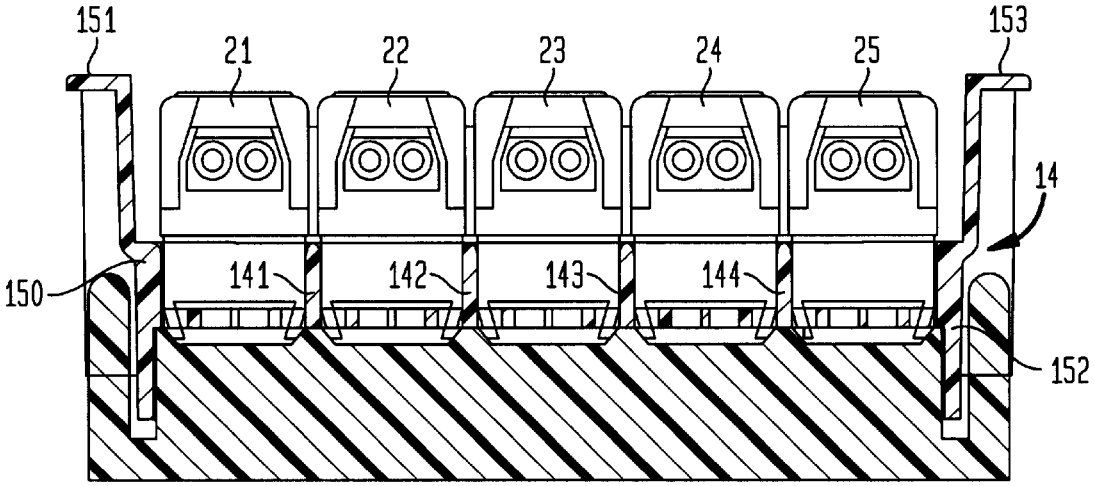
FIG. 5 is a cross-sectional view of a connector illustrating the individual latches to be spread apart to permit the latches to be disengaged from the block for disassembly of the connector from the block.

As illustrated in FIG. 5, as the housing projections 150, 152 are now fully within the troughs 350, 352 so that the projections 321, 332, 323, 324, 325 and 326 have now disengaged the latches 121; 221, 122; 222, 123; 223, 124; 224, 125; and 225 of the connector 12 from the block 14 to permit the removal of the latches 121; 221, 122; 222, 123; 223, 124; 224, 125; and 225 from the block 14 to enable disassembly of the connector 12 from the block 14. In FIG. 5, the gap between the projections 321, 332, 323, 324, 325 and 326 and the stays 141, 142, 143 and 144 of the block 14 is closed to ensure the removal of the connector 12 from the block 14.

The latch separator 301 works in three steps, first the housing projections 150, 152 are guided through the side troughs 350, 352 of the block 14. Secondly, the latch separator 301 includes projections 322, 323, 324 and 325 that engage every two opposing latches 221, 122, 222, 123, 223, 124, 224 and 125 as well as projections 321 and 326 for engaging the end latches 121 and 225. Thirdly, the latch separator 301 separates the latches to permit the disconnection of the connector 12 from the block 14.

The present invention permits the quick mounting of the connectors 21, 22, 23, 24 and 25 onto the block 14. In addition, the latch separator 301 enable the quick disassembly of the connectors 21, 22, 23, 24 and 25 from the block 14. It is necessary to provide connectors that can be quickly assembled and disassembled to enable an individual in a factory or in the field to replace damaged connectors. The quick assembly and disassembly feature minimizes the labor cost of manufacturing and repairs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A connector assembly and disassembly device comprising:

a connector array including a plurality of connections;

a block for receiving said connector array in an operative position for forming an array of individual connectors;

individual latches for securing said individual connectors to said block; and a latch separator including a plurality of projections for engaging the individual latches to enable said individual connectors to be removed from said block.

2. The connector assembly and disassembly device according to claim 1, wherein said connector array includes five connections with five pairs of latches for securing said connector array to said block.

3. The connector assembly and disassembly device according to claim 1, and further including end latches for securing end portions of said connector array to said block.

4. The connector assembly and disassembly device according to claim 1, wherein said latch separator includes at least one side trough and said block includes at least one housing projection, wherein said at least one housing projection of said block is guided within the at least one side trough of said latch separator for enabling said latch separator to engage said latches to enable said individual connectors to be removed from said block.

5. The connector assembly and disassembly device according to claim 4, wherein said latch separator includes two side troughs and said block includes two housing projections for guiding said latch separator for enabling said latch separator to engage said latches to enable said individual connectors to be removed from said block.

6. A connector assembly and disassembly device comprising:

a connector array including a plurality of connections;

a block for receiving said plurality of connections in an operative position for forming an array of individual connectors;

latches operatively connected to each of said connections for securing said connections to said block; and a latch separator including a plurality of projections for engaging individual latches of said connections for disengaging said latches from said block to enable said connections to be removed from said block.

7. The connector assembly and disassembly device according to claim 6, wherein said connector array includes five connections with five pairs of latches for securing said connections to said block.

8. The connector assembly and disassembly device according to claim 6, and further including end latches for securing end portions of said connections to said block.

9. The connector assembly and disassembly device according to claim 6, wherein said latch separator includes at least one side trough and said block includes at least one housing projection, wherein said at least one housing projection of said block is guided within the at least one side trough of said latch separator for enabling said latch separator to engage said latches to enable said connections to be removed from said block.

10. The connector assembly and disassembly device according to claim 9, wherein said latch separator includes two side troughs and said block includes two housing projections for guiding said latch separator for enabling said latch separator to engage said latches to enable said connections to be removed from said block.

* * * * *